United States Patent [19]

Bellio

[11] Patent Number: 5,069,151

[45] Date of Patent: Dec. 3, 1991

[54] METHOD AND APPARATUS FOR DETECTING SKIPPED STITCHES FOR A LOCKSTITCH SEWING MACHINE

[75] Inventor: Stephen L. Bellio, West Roxbury, Mass.

[73] Assignee: The Charles Stark Draper Laboratory, Inc., Cambridge, Mass.

[21] Appl. No.: 548,111

[22] Filed: Jul. 5, 1990

[51] Int. Cl.[5] ..... D05B 69/36

[52] U.S. Cl. ..... 112/278

[58] Field of Search ..... 112/273, 278, 277, 197, 112/199; 242/37 R

[56] References Cited

U.S. PATENT DOCUMENTS

| | | | |
|---|---|---|---|
| 3,785,308 | 1/1974 | Brandriff et al. | 112/218 |
| 3,843,883 | 10/1974 | De Vita et al. | 250/233 |
| 4,102,283 | 7/1978 | Rockerath et al. | 112/131 |
| 4,186,672 | 2/1980 | Burton | 112/273 |
| 4,192,243 | 3/1980 | Blessing et al. | 112/273 |
| 4,196,685 | 4/1980 | Tamura | 112/273 |
| 4,558,654 | 12/1985 | Schilling et al. | 112/273 X |
| 4,602,582 | 7/1986 | Rawson | 112/278 |
| 4,934,292 | 6/1990 | Mardix et al. | 112/273 |
| 4,938,159 | 7/1990 | Shibata | 112/273 |

*Primary Examiner*—Peter Nerbun

*Attorney, Agent, or Firm*—Lahive & Cockfield

[57] ABSTRACT

The invention is a method and apparatus for detecting a skipped stitch for a Class 301 lockstitch sewing machine. A monitor assembly determines the passage of the needle thread about the bobbin assembly during formation of lockstitches. A second monitor assembly determines the reciprocal movement of the needle by detecting rotation of a shaft which drives the needle. A processor identifies times when the rotational movement of the shaft does not correlate with passage of the needle thread about the bobbin assembly.

6 Claims, 4 Drawing Sheets

METHOD AND APPARATUS FOR DETECTING SKIPPED STITCHES FOR A LOCKSTITCH SEWING MACHINE

BACKGROUND OF THE DISCLOSURE

This invention relates to an apparatus and method for monitoring the stitching quality of sewing machines and, in particular, to detecting skipped stitches for Class 301 lockstitch sewing machines.

With the clothing industry becoming increasingly automated, there is a need for systems that monitor and regulate the functions and output of high speed sewing equipment. Certain of these systems are utilized to monitor the stitching of sewing machines to detect skipped stitches in apparel manufactured by Class 301 lockstitch sewing machines. The Class 301 lockstitch is employed in a wide range of areas within the apparel industry because it provides a fast, economical, and strong stitch.

In the general use of lockstitch type 301 sewing machines, improper stitches may from time to time be introduced in a workpiece. Generally, improper stitches may have the form of malformed stitches or skipped stitches. There are many causes of skipped stitches. Skipped stitches can develop from improper synchronization between the active elements within the sewing machine and the needle and bobbin thread loops. Normally, the bobbin hook catches the needle loop and brings the needle thread around the bobbin to form a lockstitch. Skipped stitches are most often formed when the bobbin hook fails to grasp the needle loop.

Malformed stitches are formed when the 301 stitch is not properly set. A stitch is properly set when the needle thread and the bobbin thread interlock in the center of the workpiece. A malformed stitch occurs when the stitch interlocks at either the top of the workpiece or the bottom of the workpiece.

In the prior art, skipped stitch detection systems are based upon monitoring the tension of the needle thread. As an example of this system, in U.S. Pat. No. 4,102,283 (Rockerarth et al.) the loss of thread tension generally is said to correspond to a skipped stitch, and this reduction in normal thread tension triggers a sensing device. The sensitivity of these systems ranges from complete loss of thread tension, for example due to the thread breaking, to sensing a momentary reduction in normal thread tension.

Other systems are based upon monitoring thread consumption, and may correlate thread consumption with total number of stitches, to detect a skipped stitch. As an example of this system, in U.S. Pat. No. 3,843,883 (DeVita et al., Oct. 22, 1974) a monitor is used to measure thread consumption which is then compared to a predetermined standard of thread use, deviation from which activates an output signal.

Another system used for detecting skipped stitches in a lockstitch type 301 sewing machine is disclosed in UK Patent Application No. GB 2008631. That system involves monitoring the length of a seam as compared with the upper thread consumption required to produce the seam. Actual thread consumption is then compared against a predetermined consumption value, any difference of which corresponds to an improperly formed seam. However, the difference in upper thread consumption between correct stitches and skipped stitches is not always substantial enough to be reliable in fast-rate sewing machines. This is best demonstrated when two pieces of thin fabric are being sewn together. Generally, measurements of the difference in thread consumption per stitch includes the thickness of two plies of fabric (assuming the stitch is set at center). For example, letting stitch length (SL)=0.125 inches, and ply thickness (PT)=0.01 inches, then the percentage decrease for a skipped stitch would be: 100 * [(2 * PT)/SL]=100 * [(2*0.010)/0.125]=16%. If thread tensions are not adjusted properly, this percent decrease could go to zero. Thus, there is a need for a direct, effective method of detecting skipped stitches in a fast-speed lockstitch type 301 sewing machine.

A primary shortcoming of the prior art is the unreliability of these systems at high sewing speeds, for example greater than 5,500 stitches per minute. DeVita states that the apparatus disclosed therein makes "mechanically possible the very high running speeds of about 2,000 stitches per minute desirable for such [lockstitch] sewing machines" (emphasis added). These systems fail to detect a momentary reduction of thread tension when the sewing machine is operating at high sewing speeds. The reduction in tension for an improper stitch at high sewing speeds tends to be less and in a range that the prior art fails to detect. As a result, these systems tend to be less reliable and thus fail to perform these functions with great accuracy.

There exists a need for better methods and systems for detecting skipped stitches that are reliable at high sewing speeds. To accommodate the advances in the clothing automation, particularly the increase in sewing speeds, it is an object of the invention to provide a simple, reliable system for detecting skipped stitches that would satisfy a substantial need in the art.

SUMMARY OF THE INVENTION

The present invention is a method and apparatus for detecting a skipped stitch for a Class 301 lockstitch sewing machine. Generally, that type of sewing machine includes an axially reciprocable needle adapted to incorporate one or more needle threads into a succession of Class 301 lockstitches and includes a rotatable bobbin assembly adapted for incorporating a bobbin thread into the lockstitches.

To detect skipped stitches, a monitor assembly determines the passage of the needle thread about the bobbin assembly during the formation of the lockstitches. A second monitor assembly determines the reciprocal movement of the needle by detecting rotation of a shaft which drives the needle. A processor identifies times when the rotational movement of the shaft does not correlate with passage of the needle thread about the bobbin assembly. Since the reciprocal movement of the needle as driven by the shaft enables the needle thread to pass around the bobbin assembly for the formation of a stitch, the identified times correspond to times when improper stitches have occurred.

In one form of the invention, the needle thread detection assembly includes an optical system having an emitter, a beamsplitter, a lens, a detector, and a reflective surface. Light is emitted from the emitter through both the beamsplitter and the lens onto the reflective surface. A detector then detects the passage of light. As the needle thread passes in front of the reflective surface, the amount of light acting upon the detector is decreased and detected by the detector. The absence of such a decrease in light during one stitch cycle indicates a skipped stitch.

In one form of the invention, the reflective surface is a retro-reflective tape which is adhered to the face of the bobbin assembly. In another form of the invention, the reflective surface is recessed below the face of the bobbin assembly.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1A:
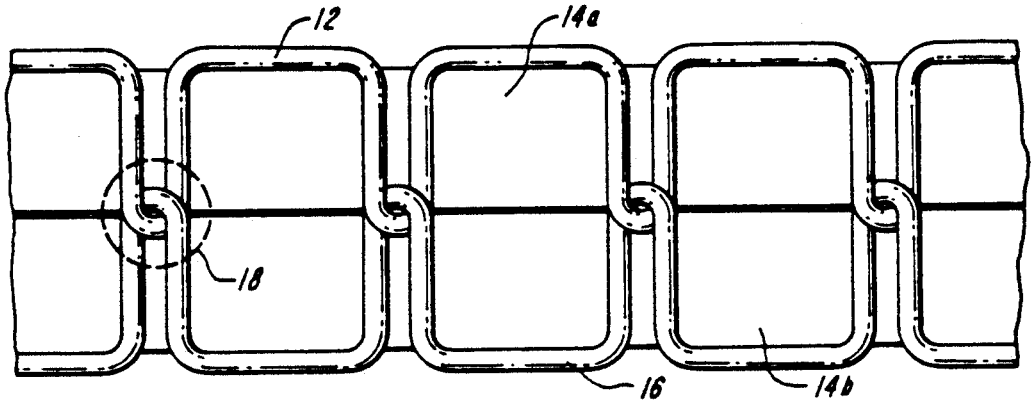
FIG. 1A shows in diagrammatic form an exemplary series of proper Class 301 lockstitches.
Figure 2B:
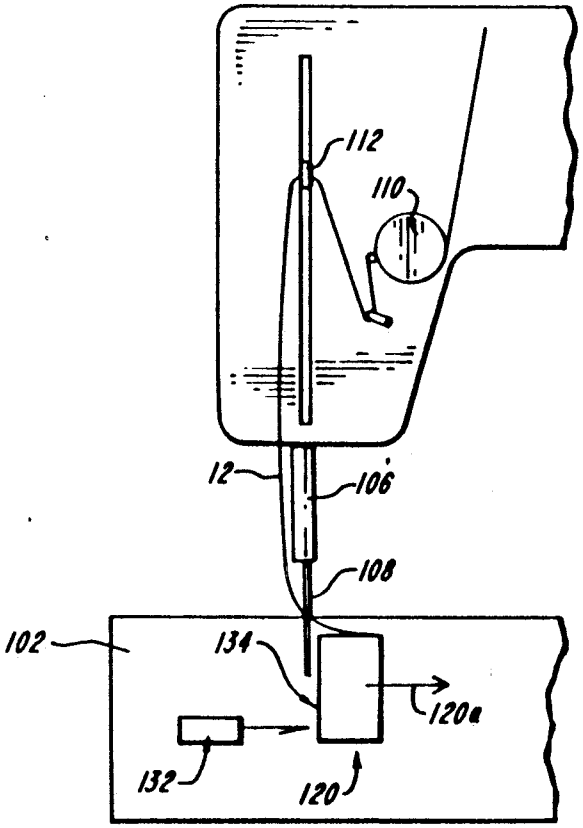
FIG. 2B shows a front elevation cut-away view of the system of FIG. 2A.
Figure 2A:
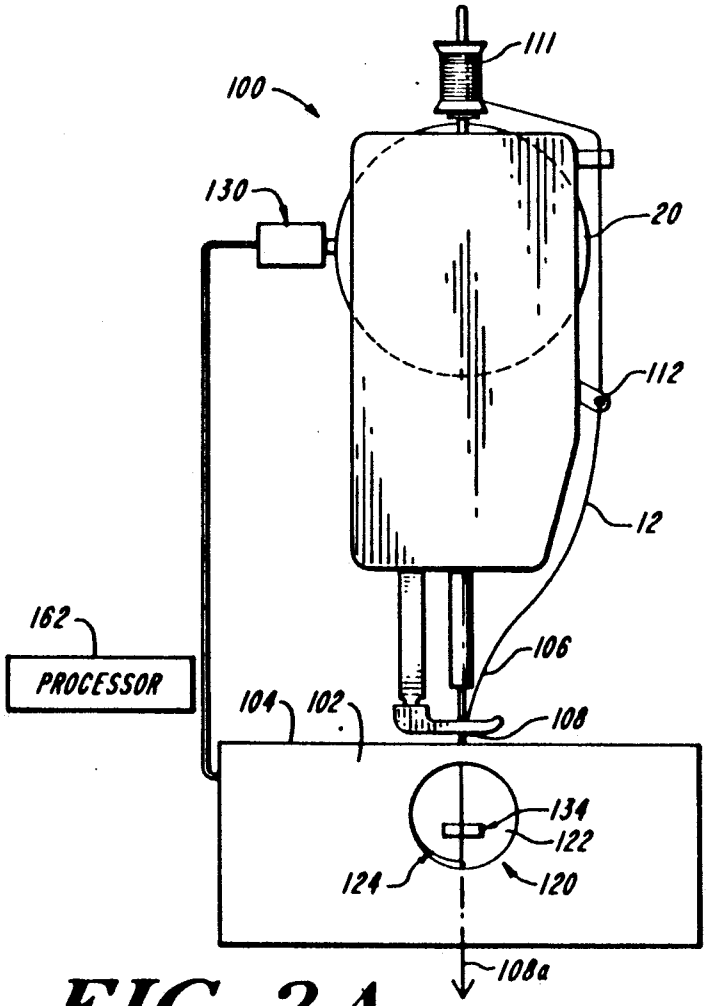
FIG. 2A shows a side elevation cut-away view of a sewing machine including a skipped stitch detection system embodying the present invention.

A diagrammatic representation of Class 301 lockstitches is shown in FIG. 1A. FIGS. 2A and 2B show general representations of a lockstitch sewing machine, adapted to include the present invention. In FIG. 1A, a needle thread 12 generally runs along the top of an upper limp material segment 14*a* and a bobbin thread 16 generally runs along the bottom of segment 14*b*. In the illustrated stitch configuration, the needle thread loops 18 are shown with exaggerated width for clarity.

Figure 1B:
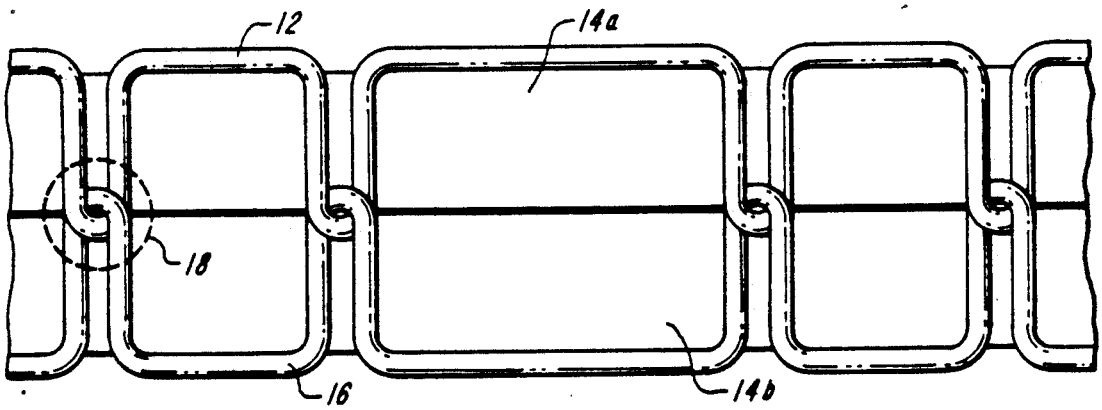
FIG. 1B shows in diagrammatic form an exemplary skipped Class 301 lockstitch.

Both the needle thread 12 and the bobbin thread 16 periodically pass partially through one or both segments 14*a* and 14*b*, interlock to form the stitches, and then return to the respective top and bottom surfaces of segments 14*a* and 14*b*. The interlocking portions of the threads are referred to herein as loops. When the lockstitch is "correctly formed", the loops from the needle thread 12 and bobbin thread 16 interlock approximately mid-way between the top and bottom surfaces of segments 14*a* and 14*b*, as shown in FIG. 1A. An exemplary skipped stitch is shown in FIG. 1B.

In practice, the interlock point location may range all the way to either the top surface of segment 14*a* or the bottom surface of segment 14*b*, thereby forming "improper" stitches. The difference in needle thread 12 consumption between correct stitches and skipped, or improper, stitches is not always substantial enough to trigger an error or skipped stitch detector systems of the prior art, especially at the speeds of over 5,500 stitches per minute.

Referring now to FIG. 2A generally, in the formation of normal or correct lockstitches, the bobbin hook 124 of sewing machine 100 catches a needle loop and brings the needle thread 12 around the bobbin case 122. A skipped stitch is the result of the bobbin hook 124 failing to grasp the needle thread 12. Based upon this characteristic of skipped stitches, the present invention provides a method and apparatus, including a processor 162 for monitoring, on a continuous basis, the needle thread as it passes around the bobbin assembly of a lockstitch sewing machine as correlated with the rotation of the main drive shaft of the machine, as an indicator of a skipped stitch.

FIG. 2A shows a side elevation cut-away view of a sewing machine 100 including a skipped stitch detection system embodying the present invention. The sewing machine 100 includes a base member 102 having a planar workpiece support surface 104, and having a needle assembly 106 with a reciprocating needle 108 extending along a vertical needle axis 108*a*. The needle 108 receives needle thread 12 from a needle thread source (111 of FIG. 2B) by way of a tension assembly 110.

Beneath the support surface 104, a bobbin assembly 120 includes a bobbin case 122 which reciprocatingly rotates about axis 120*a*. The bobbin assembly 120 further includes a bobbin hook 124 for catching the needle thread 12 as it rotates around the bobbin case 122 to form a lockstitch. Also shown in FIG. 2A is a shaft monitor assembly 130 for detecting the rotation of the shaft 20 during the formation of a lockstitch. Monitor assembly 130 is discussed in further detail below. During proper operation of the sewing machine of the illustrated embodiment of FIGS. 2A and 2B, there is one needle thread pulse for every shaft revolution pulse which can be correlated by electronic means, or otherwise, with passage of the needle thread 12 about the bobbin assembly 120. Processor 162 identifies times corresponding to rotation of the output shaft for which no passage of needle thread about the bobbin assembly is detected.

Figure 3:
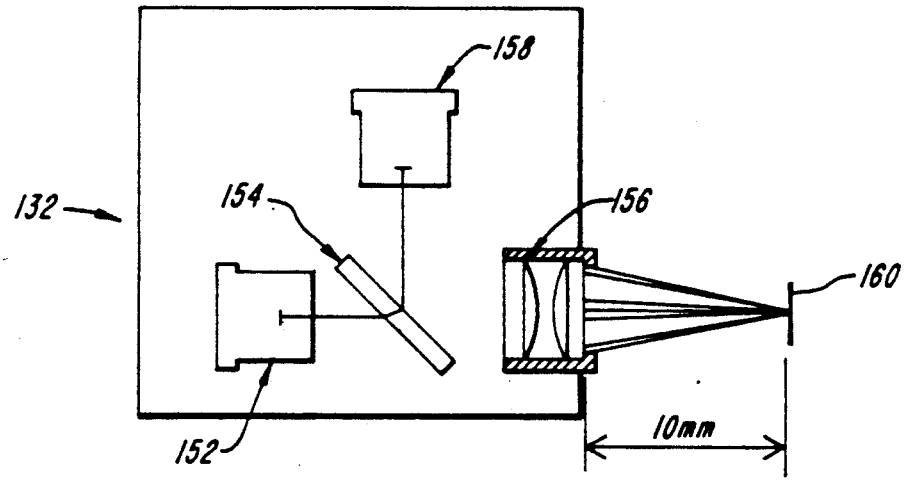
FIG. 3 shows a schematic representation of the thread monitor assembly of a skipped stitch detection system embodying the present invention.

As best shown in FIG. 2B, in a preferred embodiment of the invention, retro-reflective tape 134 is placed on the bobbin case 122, with a needle thread monitor assembly 132 proximately positioned thereto. In the preferred embodiment, the needle thread monitor assembly 132 is a control sensor. An example of such a sensor is schematically shown in FIG. 3, and includes a light emitter (LED) 152, beamsplitter 154, lens 156 and detector 158. Light from the emitter 152 passes through the beamsplitter 154 and the lens 156 to produce a spot of light on the retro-reflective tape, or other reflecting surface forming a target 160, at some distance from the lens 156. Light reflecting off this target 160 returns through the lens 156, then reflects off the beamsplitter 154 and onto the detector 158. The position and size of the optical components are selected to yield a 0.5 mm diameter spot size at a focus distance of 10.0 mm. This type of sensor is typically used with reflective surfaces. Any object that blocks the light returning from the reflective surface decreases the optical signal sensed at the detector 158.

Retro-reflective surfaces are particularly effective in reflecting a high percentage of incident light back toward the light source. The configuration of assembly 132 of FIG. 3 is such that the detector 158 optically appears to be occupying the space as the emitter 152 (or source). In the preferred embodiment, retro-reflective tape 134 is used as the target. The assembly 132 is positioned 10.0 mm from the tape 134 to give the desired yield as stated above. Normally, substantially all the energy from the emitter 152 reflects off of the retro-reflective tape 134, and back into the detector 158. When needle thread 12 passes over the target, i.e. around the bobbin case 122, the optical energy detected at 158 is decreased indicating passage of the thread 12 around the bobbin case 122.

In the preferred embodiment, the emitter is a light source. In other forms of the invention, sensors using other waveforms, e.g. acoustic, may be used. In an exemplary acoustic sensor system, an acoustic wave of specified frequency and amplitude may be directed to a reflective target surface. The interruption or disruption of such acoustic waves would indicate the passage of an object, such as a needle thread, through the wave front.

Figure 2C:
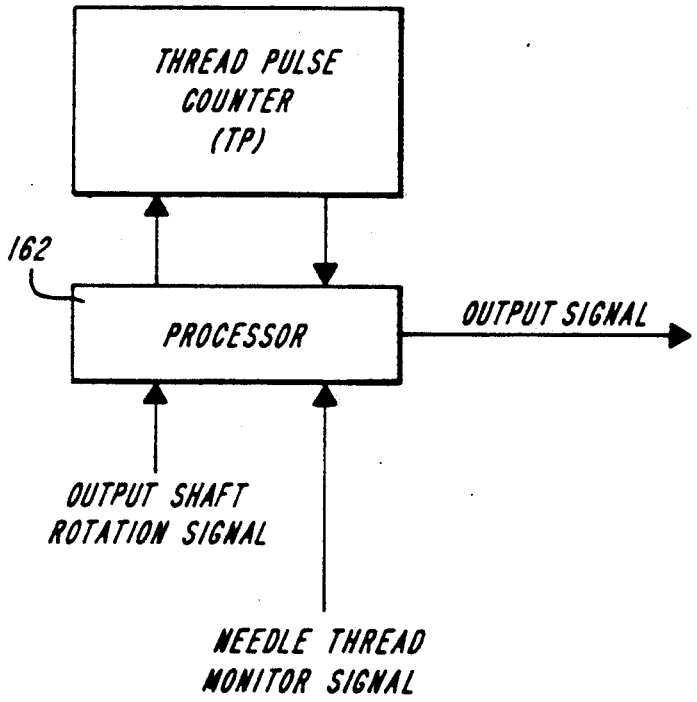
FIG. 2C shows the processor of the embodiment corresponding to FIG. 2A and FIG. 2B.
Figure 4:
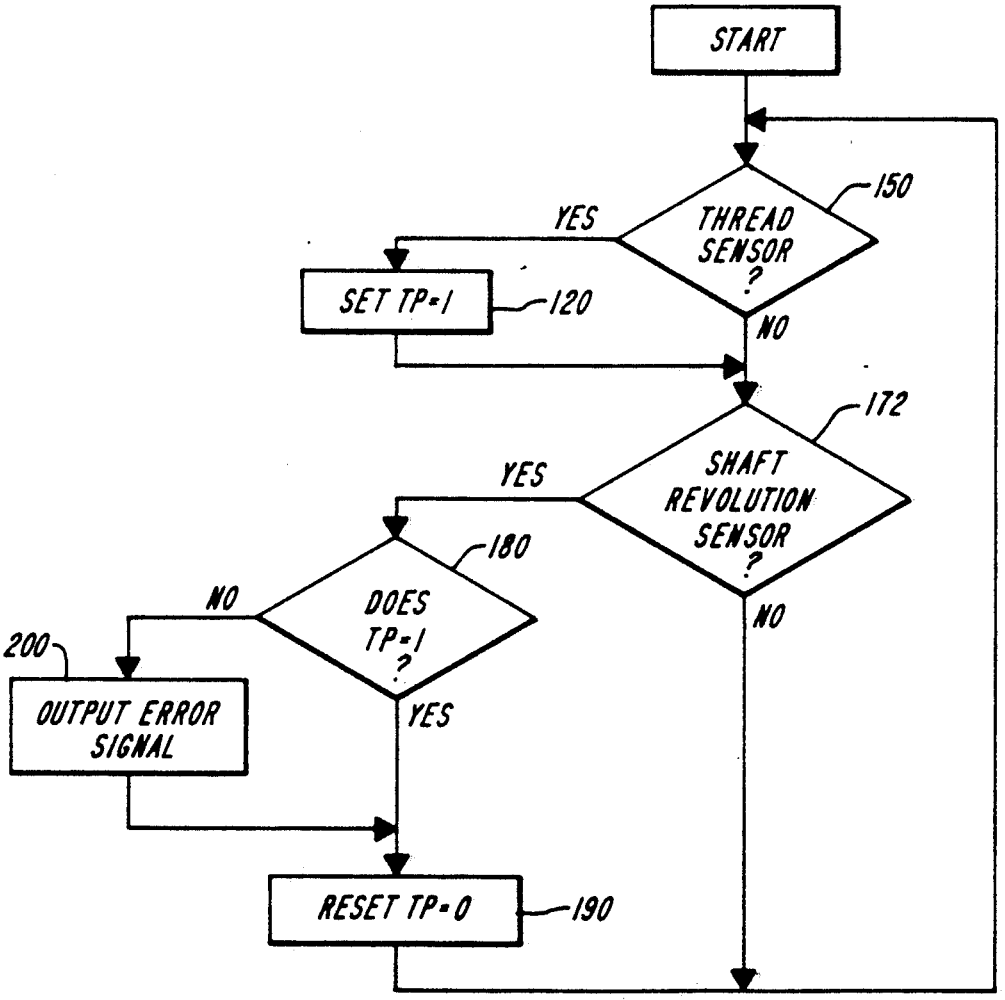
FIG. 4 shows a flow diagram of the system of the present invention.

The processor 162 of the present invention may execute the process depicted by the flow diagram of FIG. 4. In that apparatus, the system receives input from the needle thread monitor assembly 132. If passage of the needle thread about the bobbin case is detected for a stitch (block 150) on a per stitch basis, thread pulse counter (TP) is set to one (block 170); if no thread is detected about the bobbin case, the thread pulse counter remains at zero. .The system then considers the shaft monitor assembly 130 (block 172). If a signal has been received which is indicative of a revolution of shaft 20, then the system tests whether the thread pulse counter is set to one (block 180). If so, then the thread pulse counter is reset to zero (block 190) and the system is recycled. If the thread pulse counter is at zero, an output error signal is generated (block 200) to indicate a skipped stitch. (See also FIG. 2C.)

In the illustrated embodiment, the retro-reflective tape is a discrete element positioned on the face (i.e. outer) surface of a conventional bobbin case. In an alternate form of the invention, the retro-reflective tape 134 may be positioned on a portion of the bobbin case that is recessed below the nominal face surface of the bobbin case, so that the thread will not rub against the tape 134 and wear it off the surface. In yet another form of the invention, the bobbin case itself may be used as the reflective surface, or target, with the monitor assembly 132 positioned accordingly.

In yet another form of the invention, the monitor assembly 132 could be a Hewlett-Packard HBCS-1100 high resolution optical reflective sensor. While described above in conjunction with the lockstitch type 301 sewing machine improper stitch detection system, the apparatus may be used on any sewing machine which uses a bobbin in forming a stitch. It may also be used alone in other applications in which it is adapted to accurately measure rapid motion of thread, or similar elongated, flexible material, about a bobbin-type assembly.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for detecting a skipped stitch for a Class 301 lockstitch sewing machine, said machine including:

an axially reciprocal needle adapted to incorporate at least one needle thread into a succession of Class 301 lockstitches;

a drive motor having an output shaft and associated means for driving said needle through at least one reciprocal motion per stitch, said output shaft being rotatable through one full rotation per stitch; and a rotatable bobbin assembly including means for incorporating a bobbin thread into said lockstitches; comprising:

means for detecting passage of said needle thread across a face of said bobbin assembly:

means for detecting each full rotation of said output shaft; and means for identifying times corresponding to rotation of said output shaft for which no passage of said needle thread about said bobbin assembly is detected, said times being indicative of a skipped stitch.

2. Apparatus according to claim 1 wherein said needle thread detecting means comprises an optical detector system.

3. Apparatus according to claim 2 wherein said optical detector system comprises an optical sensor, said optical sensor including an emitter, a beam splitter, a lens, a detector, and an optically reflective surface affixed to said bobbin assembly and underlying the locus of passage of said needle thread during proper lockstitch formation; and including means for directing light from said emitter through both said beamsplitter and said lens onto said reflective surface;

means for directing portions of said light reflected from said reflective surface through said beamsplitter and onto said detector; whereby said needle thread passing in front of said reflective surface decreases the amount of said light normally incident upon said detector.

4. Apparatus according to claim 3 wherein said reflective surface is a discrete element affixed to a face surface of said bobbin assembly.

5. Apparatus according to claim 3 wherein said reflective surface is recessed below a nominal level of a face surface of said bobbin assembly.

6. Apparatus according to claim 4 or 5 wherein said reflective surface is retro-reflective.

* * * * *